US008413385B2

(12) United States Patent
Mahoney

(10) Patent No.: US 8,413,385 B2
(45) Date of Patent: Apr. 9, 2013

(54) SERVER SHIELD

(76) Inventor: Glenn E. Mahoney, New York, NY (US)

( * ) Notice: Subject to any disclaimer, the term of this patent is extended or adjusted under 35 U.S.C. 154(b) by 535 days.

(21) Appl. No.: 12/381,306

(22) Filed: Mar. 10, 2009

(65) Prior Publication Data

US 2010/0230058 A1 Sep. 16, 2010

(51) Int. Cl.
*E04F 10/00* (2006.01)

(52) U.S. Cl.
USPC ..... 52/36.2; 52/39; 52/63; 52/66; 52/74; 52/126.5; 135/90; 135/98; 135/124; 135/903; 160/25; 160/29; 211/180

(58) Field of Classification Search ..... 52/36.2, 52/39, 63, 64, 73, 74, 79.1, 79.9, 79.13, 86, 52/66, 126.5, 122, 122.1; 135/90, 98, 124, 135/903; 160/25, 29; 211/180
See application file for complete search history.

(56) References Cited

U.S. PATENT DOCUMENTS

| | | | | |
|---|---|---|---|---|
| 544,871 | A * | 8/1895 | Turner | 135/90 |
| 2,031,568 | A * | 2/1936 | Mason | 52/584.1 |
| 3,256,664 | A * | 6/1966 | Brunnzell | 52/478 |
| 3,584,910 | A * | 6/1971 | Lupul | 160/23.1 |
| 4,327,530 | A * | 5/1982 | Bush | 52/66 |
| 4,433,788 | A | 2/1984 | Erlam et al. | |
| 4,572,597 | A | 2/1986 | Voigt et al. | |
| 5,271,634 | A * | 12/1993 | Walton | 160/23.1 |
| 5,305,187 | A | 4/1994 | Umezu et al. | |
| 5,862,633 | A * | 1/1999 | Van Ells | 52/3 |
| 5,867,950 | A * | 2/1999 | Claisse | 52/66 |
| 6,168,249 | B1 | 1/2001 | Chien | |
| 6,657,861 | B2 | 12/2003 | Irmer | |
| 2002/0046979 | A1 | 4/2002 | Larsen et al. | |
| 2007/0213000 | A1 | 9/2007 | Day | |
| 2007/0232134 | A1 | 10/2007 | Desrochers et al. | |

* cited by examiner

*Primary Examiner* — Joshua J Michener
*Assistant Examiner* — Matthew J Smith
(74) *Attorney, Agent, or Firm* — MacCord Mason PLLC

(57) ABSTRACT

An electrical equipment rack, such as a computer server rack, with a protective shield to protect the electrical equipment rack and equipment thereon from water damage is described. In general, the shield is constructed of a curved polycarbonate shell fastened to an aluminum frame having arc-shaped end sections attached to spaced elongated side rails. The aluminum frame is attachable to threaded rod hangers of the type that are used in most server rack rooms. Multiple shields may be fastened together end-to-end to increase the length of the overall shield, to extend over the entire length of the server racks or cabinets needed to be protected. Gaskets such as neoprene seals are compressed between shield sections to prevent water from penetrating between the fastened sections. Deployable curtains are fastened to the elongated side rails to further protect the electrical equipment rack from water damage.

18 Claims, 6 Drawing Sheets

SERVER SHIELD

BACKGROUND OF THE INVENTION (1). Field of the Invention

The present invention relates to a protective covering for open electrical equipment and computer server racks. In particular, the present invention relates to a shield or canopy to prevent water damage to server computers and other electrical equipment mounted in open equipment racks.

(2). Description of the Prior Art

Earthquakes, tornadoes, hurricanes and other unexpected events can damage the roofs and ceilings of buildings housing electrical equipment racks, such as computer server racks. Severe roof damage will allow rain water to pour through ceilings, causing major damage to sensitive and expensive electrical equipment and computer servers mounted in open electrical equipment racks. Other water sources, such as burst water pipes, leaking HVAC systems, sub-grade water infiltration, and broken windows can also result in water damaged electrical equipment.

Present measures to prevent water damage to computer servers and other electrical equipment mounted to open equipment racks have proven inadequate. For example, in recognition of this water damage problem, attempts are made to locate server rooms in areas of a building that are considered to be relatively safe from roof failure and other causes of water damage. However, server and electrical equipment room location is not always an option due to cost constraints and building architecture. Therefore, a need remains for an effective shield against water damage and falling debris for computer server and electrical equipment racks.

SUMMARY

The present invention is directed to a water shedding and debris shield for use with an electrical equipment rack to protect electrical equipment racks, such as computer server racks, from water damage in case of a failure of the server room ceiling. In general, the server shield is made up of a waterproof shell or cover, preferably a transparent or translucent cover, fastened to an aluminum frame having arc-shaped end sections joined by spaced, parallel, elongated side rails. The aluminum frame is supported at a spaced distance over the electrical equipment rack, e.g., with threaded rods bolted to hangers that are pre-installed in most server rooms to support cable racks. Individual sections of the server shield may be fastened together end-to-end to increase the length of the overall shield, which is dictated by the length of the server racks or cabinets being protected. Gaskets such as neoprene seals, usually with aluminum T flashing, are compressed between fastened server shield sections to prevent water from penetrating between the fastened sections. Deployable curtains may also be attached to the elongated side rails. The curtains can be quickly moved from a raised, stored position to a downward deployed position to further protect the shielded equipment racks from water damage. For example, the curtains may be rolled up in the raised position and rolled down to their deployed position.

In one embodiment, the arc-shaped server shield end sections have an arc in the range from about 120° to about 180°, and a radius of from about 34 inches to 40 inches, when the shield is designed to cover and protect equipment racks having aisles on either side. This embodiment is preferably attached to the ceiling over the equipment rack to be protected. Alternately, the shield can be attached over an equipment rack with threaded rods extending upwardly from the equipment rack.

Another embodiment of the shield may be used to cover equipment racks placed against a wall. In this alternate embodiment the shield is has an arc of from about 60° to about 90° and a radius of about 80 inches to 85 inches, with the upper end of the arc being attached to the wall so that the shield extends outwardly from the wall over the server rack. A seal is positioned at the interface of the shield and wall to prevent water from migrating along the wall to the rack. In either embodiment, elongated side rails connect to the end section arcs to form a frame to which the shell is fastened. The shell follows the contour of the end sections. Additional reinforcing arc-shaped sections may be attached to the side rails at locations between the end sections. The preferred fasteners used to attach the half or reduced server shield to the wall or equipment rack are bolts and threaded rods with nuts and washers.

The shell or cover is preferably made from a rectangular semi-rigid or rigid sheet of a plastic, such as polycarbonate. Alternately, the shell can be made of a sheet metal such as aluminum or a composite material such as fiberglass. Other materials can be used for the shell as long as they are impervious to water and are rigid enough to withstand falling debris, such as ceiling tiles and insulation.

Another important feature of the shield is the deployable, e.g., roll down, curtains, which are preferably made from rectangular sheets of a plastic, such as polyvinyl chloride (PVC) sheet. Other curtain materials include, but are not limited to, waterproof canvas and other water-impervious flexible material. The curtains are attached to the side rails of the shield frame. The curtains are preferably as wide as the side rails are long, and are at least as long as the equipment rack being protected is tall. In one embodiment, the curtains are manually rolled up into a stored position and down into a deployed position. Releasable fasteners, e.g., hook and loop fasteners, are used to maintain the curtains in their stored positions. When deployed, the curtains substantially cover the sides of the covered area. When raised, however, the curtains do not interfere with normal access to rack equipment.

In another embodiment, at least one drive system to raise and lower the curtains is mounted on the shield frame and is in communication with the curtains. For example, if the curtains are rolled onto a roller, the drive system can be in communication with the roller via gearing or a drive belt. The drive system includes at least one motor that can be automatically switched on via an electrical switch in communication with a water sensor to automatically deploy the curtains to their deployed position when water is detected by the water sensor. The curtains preferably have weighted bottom ends to hold the curtains in their deployed position.

The server shield may also be used to prevent water damage to property other than electrical equipment and computer server racks. For example, the shield may be mounted over medical equipment such as Magnetic Resonance Imaging (MRI) machines or over individual library book cases to protect library books from water damage. These and other aspects of the invention will be obvious to one skilled in the art upon a reading of the detailed description of the preferred embodiment which follows, taken together with the drawings.

DESCRIPTION OF THE PREFERRED EMBODIMENTS

Figure 1:
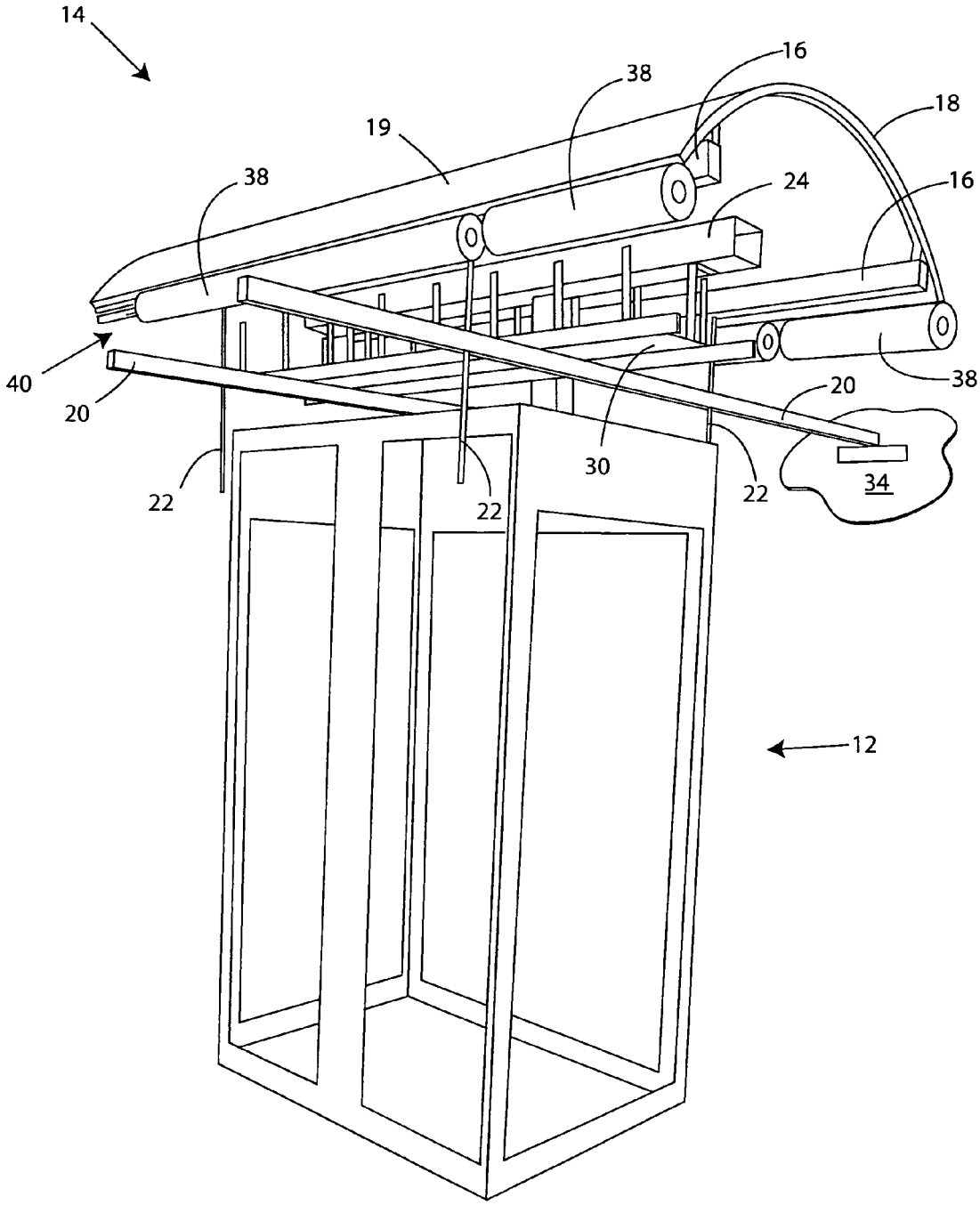
FIG. 1 is a top perspective view of a server shield constructed according to the present invention.

In the following description, like reference characters designate like or corresponding parts throughout the several views. Also in the following description, terms such as "forward," "left," and "downwardly," are words of convenience and are not limiting terms.

Figure 2:
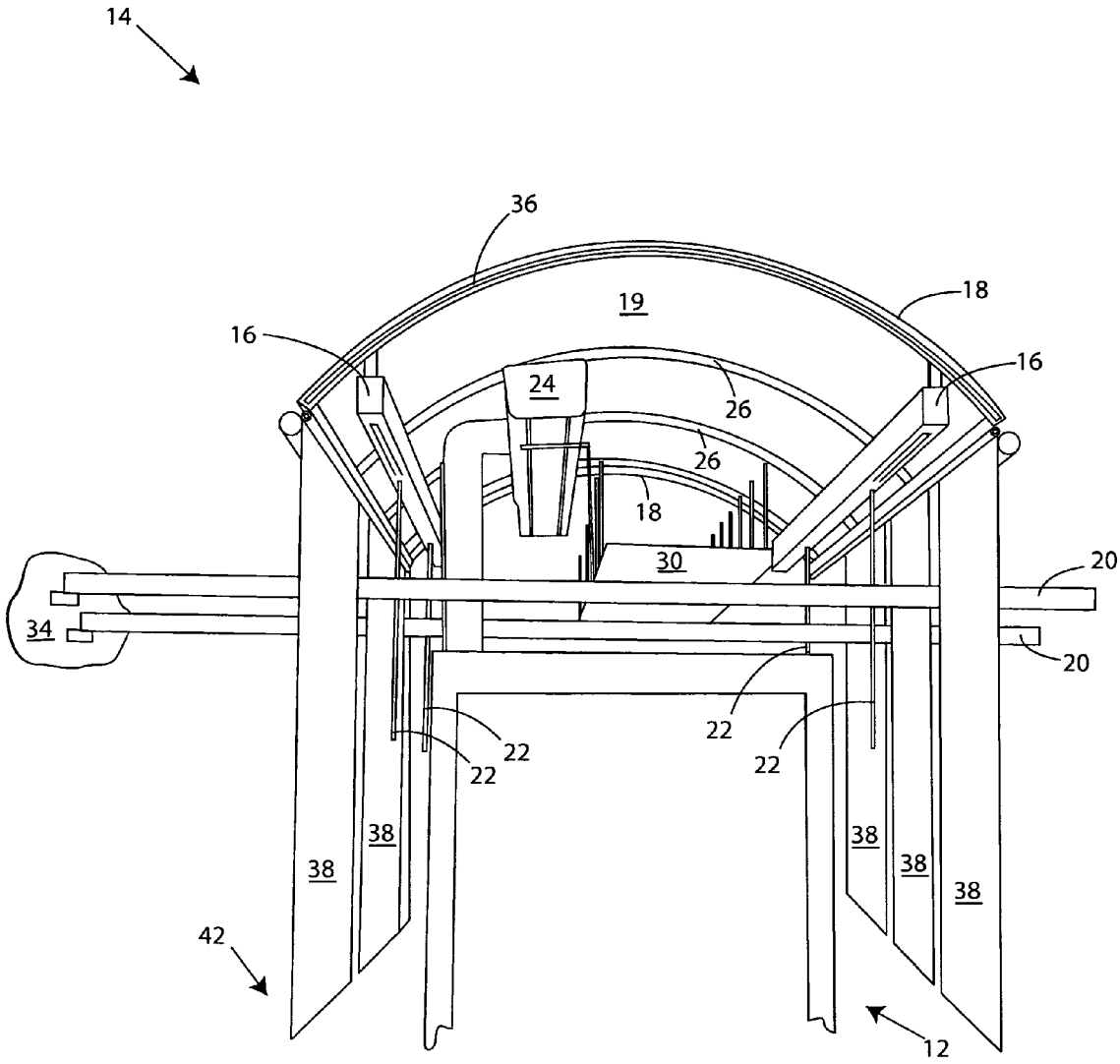
FIG. 2 is an end perspective view of a portion of the server shield of FIG. 1.

FIGS. 1 and 2 illustrate one embodiment of the present invention comprised of an electrical equipment rack 12 covered by protective shield, generally 14. Shield 14 is comprised of a frame having elongated side rails 16 joined by arc-shaped end sections 18. An attached waterproof shell 19 is attached to rails 16 and sections 18 and follows the contour of upper surfaces of the end sections 18, which are sized to cover electrical equipment racks having user traffic aisles on either side, with the sides of shell 19 extending outwardly beyond the sides of rack 12.

Figure 5:
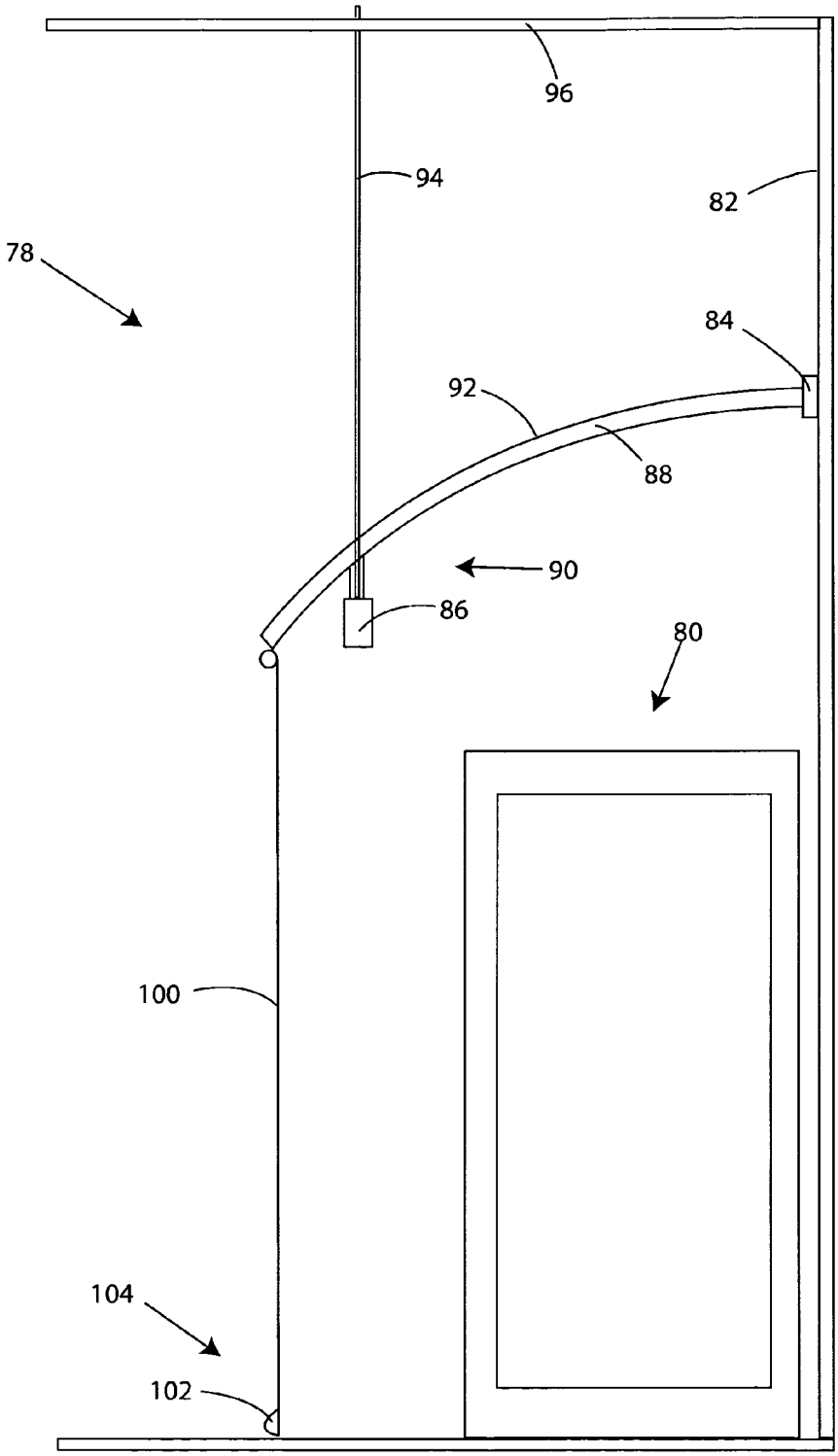
FIG. 5 is an end view of a half shield attached to a wall over a server rack adjacent the wall.

Preferably, end sections 18 have an arched upper surface of from about 120° to about 180° and a radius of from about 34 to about 40 inches in the case of equipment racks having aisle access from both of its sides. On the other hand, as illustrated in FIG. 5, the arc of the end sections is from about 60° to about 90° and the radius is about 80 inches to about 85 inches for electrical racks that are positioned against a wall with one access aisle. In the former case, a three point arc normally has a radius of about thirty-four inches.

As shown in FIGS. 1 and 2, at least one support 20 is attached to shield 14 by way of threaded rods 22, which can be used to adjust the height of shield 14 above equipment rack 12. This adjustable height feature allows space to be allocated for components such as a cable management trough 24 and cable management tray 30 and the dissipation of heat from the equipment. The at least one support 20 attaches to a wall 34 or other building structure to hold the waterproof shield 14 over equipment rack 12. Additional reinforcing arc-shaped sections 26 may be attached to side rails 16 at locations between the end sections 18.

Shield 14 preferably has a length of about eight feet. Any number of sections of shield 14 can be joined together end-to-end to extend over longer rows of electrical equipment and server racks. Gasket 36, fixed to either or both of arced end sections 18, is compressed between joined sections of shield 16 to prevent water from leaking through the interface of the joined sections.

Roll-down curtains 38 used to protect the sides of electrical equipment rack 12 from water damage are attachable to the side edges of shield 14. Curtains 38 have a rolled up stored position 40 as shown in FIG. 1, and a rolled down vertically extended deployed position 42 shown in FIG. 2. Curtains 38 are preferably made of rectangular sheets of flexible plastic, and in particular polyvinyl chloride (PVC) sheets. As best seen in FIG. 1, the curtains 38 can be slotted or spaced for mounting between the at least one support 20.

Figure 3:
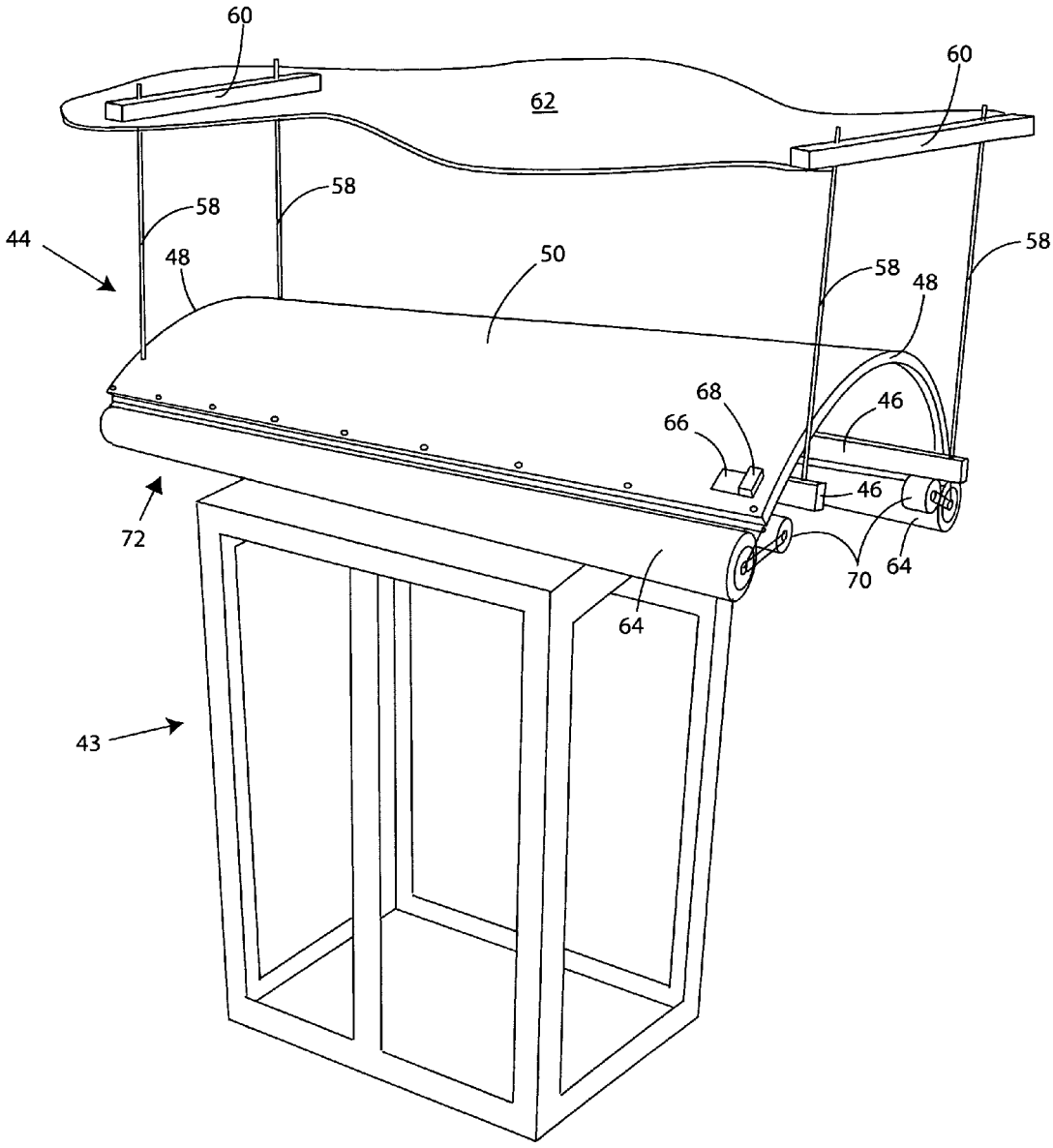
FIG. 3 is a top perspective view of another embodiment of the sever shield of the present invention that includes electric motors and drives for automatically raising and lowering protective curtains.
Figure 4:
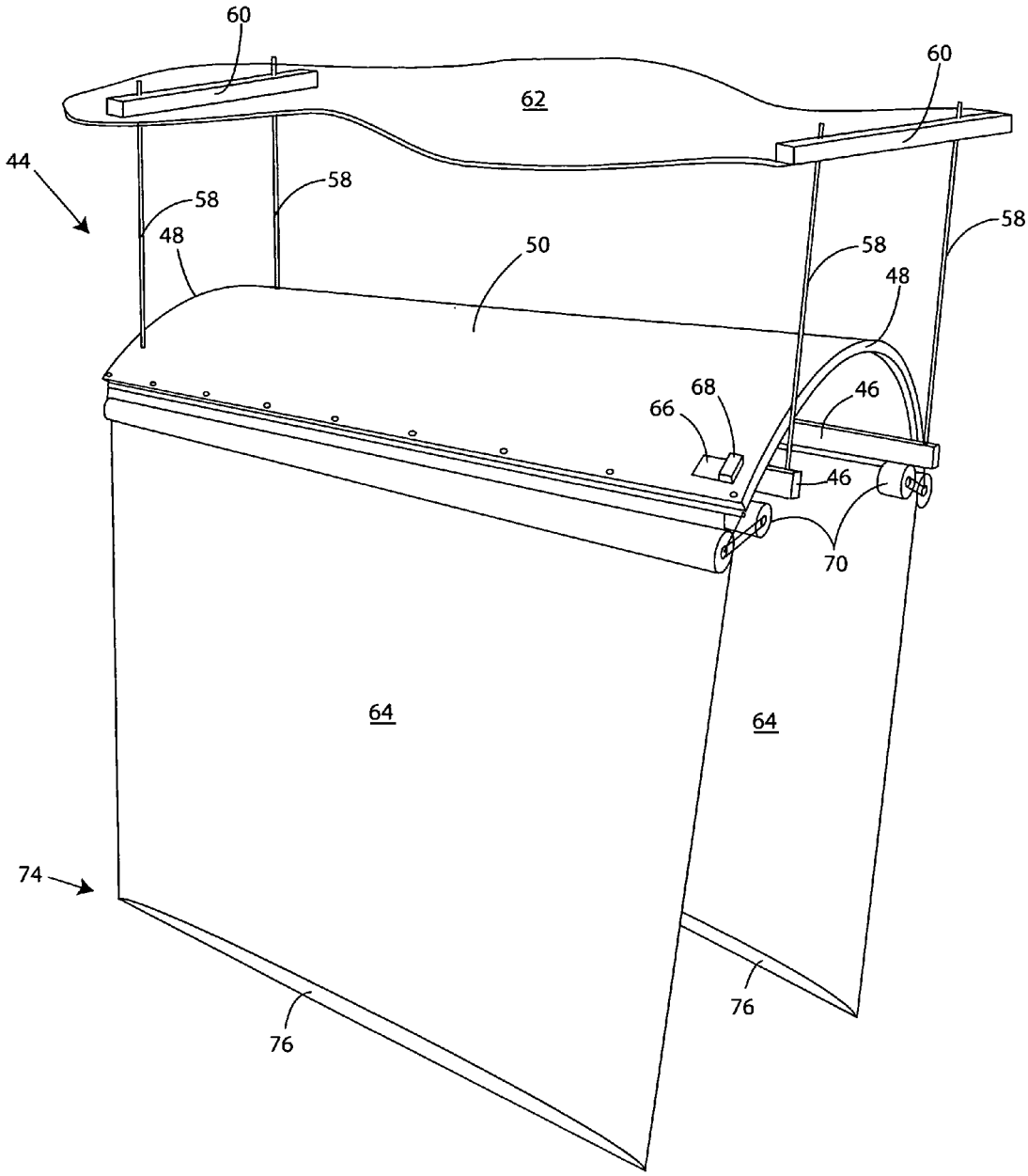
FIG. 4 shows the curtains of FIG. 3 in their deployed position.

FIG. 3 depicts another embodiment of the present invention comprised of electrical equipment rack 43, and shield, generally 44 having a frame with spaced side rails 46 joined at their ends by arc-shaped sections 48, and a curved cover 50 attached to the top of the frame. As shown in FIGS. 3 and 4, the shield 44 is held over equipment rack 43 by threaded rods 58 attached to supports 60 on ceiling 62. The relative distance between the ceiling 62 and the shield 44 can be adjusted via the threaded rods 58.

Automatically deployable curtains 64 to further protect electrical equipment rack 43 from showers of water and debris are attachable to the side edges of shield 44. Water sensor 66 in communication with electrical switch 68 activates a least one electric motor and drive system 70 to automatically deploy curtains 64 when water sensor 66 detects water. FIG. 3 shows curtains 64 in a rolled up stored position 72. In contrast, FIG. 4 shows the curtains 64 in a rolled down deployed position 74. Weights 76 attached to the ends of curtains 64 maintain curtains 64 in their deployed position 74.

FIG. 5 depicts yet another embodiment of the shield, generally 78, which may be used to cover an equipment or server rack 80 placed against a wall 82. In this alternate, embodiment the shield 78 has an arc of from about 60° to about 90° with a radius of about 80 inches to 85 inches, with the upper end of the arc being attached to wall 82 so that the shield extends outwardly from the wall over server rack 80. A seal 84 is positioned at the interface of shield 78 and wall 82 to prevent water from migrating along wall 82 to rack 80. An elongated side rail 86 connects to end section arcs 88 to form a frame 90 to which a shell 92 is fastened. Shell 92 follows the contour of end section arcs 88. At least one threaded rod 94 attached to a ceiling support 96 holds shield 78 over server rack 80. A curtain 100 having an end weight 102 is shown in its deployed position 104.

Figure 6:
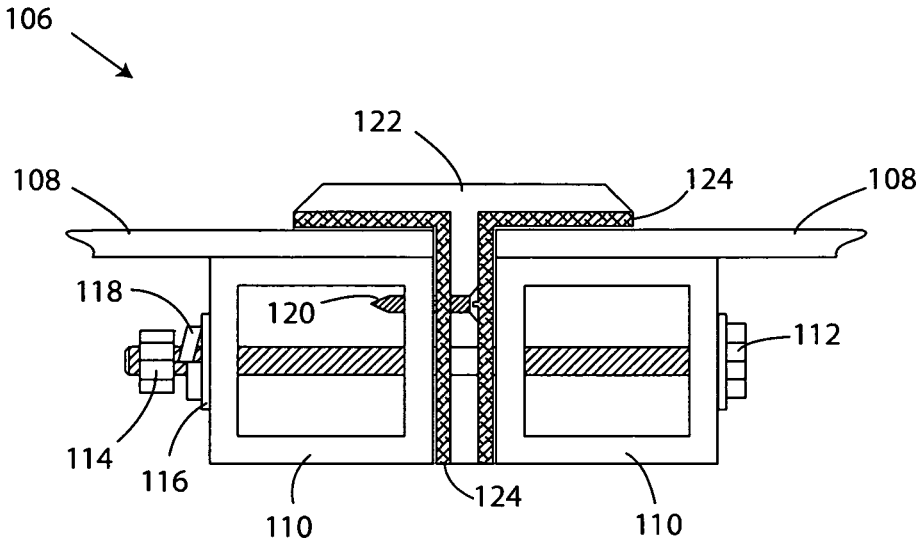
FIG. 6 depicts a sealed joint between two server shields that are fastened end to end.

FIG. 6 depicts a sealed joint between two server shields that are fastened end to end. The shield joint, generally 106 is made up of two server shells 108 attached to two shield end sections 110 that are fastened together by at least one bolt 112 having a nut 114, a flat washer 116 and a lock washer 118. A sheet metal screw 120 fastens a T-flashing 122 having neoprene adhesive gaskets 124 that are sandwiched between the end sections 110. The top of T-flashing 122 compresses a portion of each of gaskets 124 onto shells 108. T-flashing 122 is preferably made of aluminum, but could also be made of plastic.

Certain modifications and improvements will occur to those skilled in the art upon a reading of the foregoing description. For example, the waterproof shield is preferably made from polycarbonate plastic. However, constructing waterproof shield from a composite fiberglass material or a sheet metal might be better suited in some circumstances. It should be understood that all such modifications and improvements have been deleted herein for the sake of conciseness and readability but are properly within the scope of the following claims.

What is claimed is:

1. A water and debris shedding shield combined with and to protect an electrical equipment rack within a room having a ceiling and wall from water damage, said shield comprising:

a) a frame having parallel, spaced elongated side rails attached at their ends to parallel end sections with arc-shaped upper surfaces;

b) a waterproof semi-rigid or rigid shell attached to said frame and extending over said rack and outwardly beyond said rack, such that said waterproof shell follows the arc of said sections, whereby said shell prevents water and debris from falling onto said electrical equipment rack;

c) threaded rods extending from said frame for attachment to a wall or ceiling to support said shield over said electrical equipment rack; and d) at least one side curtain extending from said frame, said curtain having a raised stored position and a deployed position extending vertically downward from said frame.

2. The shield of claim 1, further including at least one electrical drive system to raise and lower said curtain.

3. The shield of claim 2, including a water sensor in communication with an electrical switch to activate said drive system to automatically deploy each of said curtains to their deployed position when said water sensor detects water.

4. The shield of claim 1, wherein said curtains are comprised of rollable polyvinyl chloride (PVC) sheets.

5. The shield of claim 1, wherein said waterproof shell is a polycarbonate sheet.

6. The shield of claim 1, wherein said end sections have an arc of from about 120° C. to about 180°.

7. The shield of claim 1, wherein said end sections have an arc of from about 60° to 90°.

8. The shield of claim 1, further including gaskets that are compressible between fastenable server shield sections to prevent water from leaking between fastened server shields.

9. In combination, an electrical equipment rack and a protective shield to protect the electrical equipment rack from water damage within a room having a ceiling and wall comprising:

a) an electrical equipment rack;

b) a frame having parallel, spaced elongated side rails attached at their ends to parallel end sections with arc-shaped upper surfaces;

c) a waterproof semi-rigid or rigid shell attached to said frame and extending over said rack and outwardly beyond said rack, such that said waterproof shell follows the arc of said sections, whereby said shell prevents water and debris from falling onto said electrical equipment rack;

d) threaded rods extending from said frame for attachment to a wall or ceiling to support said shield over said electrical equipment rack; and e) at least one side curtain extending from said frame, said curtain having a raised stored position and a deployed position extending vertically downward from said frame.

10. The rack and shield of claim 9, wherein said shield further includes at least one electrical drive system to raise and lower said curtain.

11. The rack and shield of claim 10, wherein said shield further includes a water sensor in communication with an electrical switch to activate said drive system to automatically deploy each of said curtains to their deployed position when said water sensor detects water.

12. The rack and shield of claim 9, wherein said end sections have an arc of from about 120 to about 180°.

13. The rack and shield of claim 9, wherein said end sections have an arc of from about 60° to 90°.

14. The rack and shield of claim 9, further including gaskets that are compressible between fastenable server shield sections to prevent water from leaking between fastened server shields.

15. A combination computer server rack and water and debris shedding shield to protect said rack within a room having a ceiling and wall from water and debris damage, said combination rack and shield comprising:

a) an equipment storage rack;

b) a shield having a frame with elongated side rails attached to end sections with arc-shaped upper surfaces, and an arc-shaped waterproof semi-rigid or rigid shell extending over said equipment rack and outwardly beyond said rack, and attached to said shield frame;

c) vertical threaded rods extending from said shield frame to mount said shield frame and shell over said equipment rack; and d) at least one deployable curtain attached to said shield frame, said curtain having a raised stored position and a deployed position extending vertically downward from said frame, said shell preventing water and debris from failing onto said electrical equipment rack when said curtain is in either position.

16. The rack of claim 15, further including at least one electrical drive system to raise and lower said curtain.

17. The rack of claim 16, further including a water sensor in communication with said electrical drive system to activate said drive system to move said curtain to its deployed position when said water sensor detects water.

18. The rack of claim 15, wherein said vertical threaded rods extend upwardly from said shield frame elongated side rails.

* * * * *